US005730626A

United States Patent [19]

Tomita et al.

[11] Patent Number: 5,730,626

[45] Date of Patent: Mar. 24, 1998

[54] CONNECTOR APPARATUS

[75] Inventors: Yoshinori Tomita; Naomi Suzuki, both of Shizuoka, Japan

[73] Assignee: Yazaki Corporation, Tokyo, Japan

[21] Appl. No.: 727,217

[22] Filed: Oct. 8, 1996

[30] Foreign Application Priority Data

Oct. 9, 1995 [JP] Japan ..... 7-261625

[51] Int. Cl.[6] ..... H01R 13/40

[52] U.S. Cl. ..... 439/595

[58] Field of Search ..... 439/595, 752, 439/923, 940

[56] References Cited

U.S. PATENT DOCUMENTS 4,797,116 1/1989 Isohata et al. ..... 439/274

5,071,369 12/1991 Denlinger et al. ..... 439/595

5,211,582 5/1993 Morse et al. ..... 439/589

5,529,515 6/1996 Ohtaka et al. ..... 439/595

*Primary Examiner*—Gary F. Paumen

*Assistant Examiner*—T C. Patel

*Attorney, Agent, or Firm*—Sughrue, Mion, Zinn, Macpeak & Seas, PLLC

[57] ABSTRACT

A connector apparatus has a housing, terminal receiving chambers into which terminals are inserted, and a terminal fixing front holder which is fitted in the housing from the front end portion of the housing. The terminal fixing front holder has a pull-out portion and a pull-out guide portion extending inward from the front wall portion, whereas an opening for use in inserting a Jig is bored in a front wall portion in order to smoothly pull out the front holder.

18 Claims, 5 Drawing Sheets

CONNECTOR APPARATUS

BACKGROUND OF THE INVENTION

1. Field of the Invention

The present invention relates to a connector apparatus for electrical wiring and more particularly to the construction of an improved positive terminal connector.

2. Background

As shown in FIGS. 5 through 7, for example, a typical conventional connector apparatus has been constructed so that its housing collectively accommodates a plurality of positive or negative terminals each connected to a plurality of electrical wires and that it is detachable from the wires.

FIG. 5 is a partial cutaway perspective view of a conventional connector 1, FIG. 6 is a vertical sectional view of the connector 1, and FIG. 7 is a vertical sectional view of another conventional connector 1.

Such a conventional connector 1 includes a housing 2 made of injection-molded synthetic resin, a front holder 3 for fixing terminals, waterproofing plugs 4 and a plurality of positive terminals 6 each connected to electrical wires.

The housing 2 has a hood portion 2*a* for protecting the positive terminals 6, in which hood portion a plurality of terminal receiving chambers 7 are bored, whereby the electrical joints 6*a* of the plurality of positive terminals 6 can separately be fitted in the respective chambers. Further, on the inner wall of each terminal receiving chamber 7 is a lance 9 having a protrusion capable of mating with a recess 8 formed in the body of the positive terminal 6.

The front holder 3 is inserted from the open end of the hood portion 2*a* having a plurality of spacers 12 and forming the front end portion of the housing 2, whereas tip ends of the positive terminals 6 are each passed through a plurality of holes 11 bored in the front wall portion 10 of the front holder 3 for fixing the terminals. Further, the plurality of spacers 12 extended from the front wall portion 10 are fitted into respective grooves 13 cut in a manner adjacent to the respective terminal receiving chambers 7 within the housing 2.

The deflection of the lance 9 is regulated by the spacer 12 fitted into the groove 13, so that the positive terminal 6 is completely fixed as the retaining protrusion provided for the lance 9 mates with the recess 8 of the positive terminal 6. The waterproofing plug 4 attached to the wire is fitted into one end portion of the housing 2 to hermetically seal each wire passed therethrough.

The conventional connector 1 is made so that it is necessary to remove by sheer force the front holder 3 press-fitted into the hood portion 2*a* of the housing 2 for the purpose of inspecting and maintaining the vicinity of the terminals 6. Therefore, as shown in FIG. 6, an inserted guide piece 14 has been made to stick out of the front wall portion 10 of the front holder 3 for fixing the terminals and an opening 15 has also been bored therein so that the retaining head 17 of a pull-out tool 16 having a substantially L-shaped section is allowed to engage with the opening.

Since the opening 15 is directed to the inner wall face of the hood portion 2*a* of the housing 2, however, the tip end of the retaining head 17 abuts against the inner wall face of the hood portion 2*a* via the opening 15 when the front holder 3 is pulled out and tends to scratch the inner wall face as the front holder is pulled out in the direction of an arrow A. Consequently, the scratches have constituted a primary factor in causing the trouble of hampering the smooth insertion and coupling of negative terminals (not shown) to the connector.

In order to cope with the trouble above, it has been proposed to do away with passing the inserted guide piece 14 therethrough by cutting a shallow long groove 18 in the surface thereof instead, as shown in FIG. 7. However, the groove allows the retaining head 17 to easily come off the opening because it is shallow and scratches are unavoidably left on the inner wall face of the hood portion 2*a*.

SUMMARY OF THE INVENTION

An object of the present invention intended to solve the foregoing problems with the conventional connector apparatus is to provide a connector apparatus allowing its front holder to be pulled out smoothly.

The above object of the present invention is accomplished by a connector apparatus including a housing, terminal receiving chambers into which terminals are inserted, and a terminal fixing front holder which is fitted in the housing from the front end portion of the housing, wherein the terminal fixing front holder has a pull-out portion and a pull-out guide portion extending inward from a front wall portion, whereas an opening for use in inserting a Jig is bored in the front wall portion.

The above object of the present invention is accomplished by the connector apparatus in which the pull-out portion is formed between the front wall portion and the rear portion of a spacer portion extending inward from the front wall portion along the same axial line as that of the pull-out guide portion.

The above object of the present invention is accomplished by the connector apparatus in which an internal space sectioned with the spacer portion, the front wall portion and the guide portion is completely surrounded therewith in such a condition that the retaining head of a pull-out tool is pulled out.

The above object of the present invention is accomplished by the connector apparatus in which the pull-out guide portion is extended up to substantially the same length of the spacer portion.

In the connector apparatus according to the present invention including the housing, the terminal receiving chambers into which terminals are inserted, and the terminal fixing front holder which is fitted in the housing from the front end portion of the housing, the terminal fixing front holder has the pull-out portion and the pull-out guide portion extending inward from the front wall portion, whereas the opening for use in inserting a jig is bored in the front wall portion, whereby the whole front holder is smoothly guided and pulled out by the pull-out portion and the pull-out guide portion via the front wall portion in parallel to the inner wall face of the hood portion of the housing.

In the connector apparatus according to the present invention, further, since the pull-out portion is formed between the front wall portion and the rear portion of the spacer portion extending inward from the front wall portion along the same axial line as that of the pull-out guide portion, it is ensured that the retaining head of the pull-out tool engages with the pull-out portion without touching the inner wall face of the hood portion.

In the connector apparatus according to the present invention, further, since the internal space sectioned with the spacer portion, the front wall portion and the pull-out guide portion is completely surrounded therewith in such a condition that the retaining head of the pull-out tool is pulled out, the inner wall face of the hood portion is suppressed from being scratched thereby while the pull-out tool is inserted and pulled cut.

In the connector apparatus according to the present invention, further, since the pull-out guide portion is extended up to substantially the same length of the spacer portion, the inner wall face of the hood portion is effectively suppressed from being scratched by the retaining head of the pull-out tool and the front holder is never unsmoothly pulled out when it is pulled out because it is prevented from tilting in the hood portion.

DETAILED DESCRIPTION OF THE PREFERRED EMBODIMENT

A detailed description will subsequently be given of a connector apparatus embodying the present invention with reference to the accompanying drawings.

Figure 1:
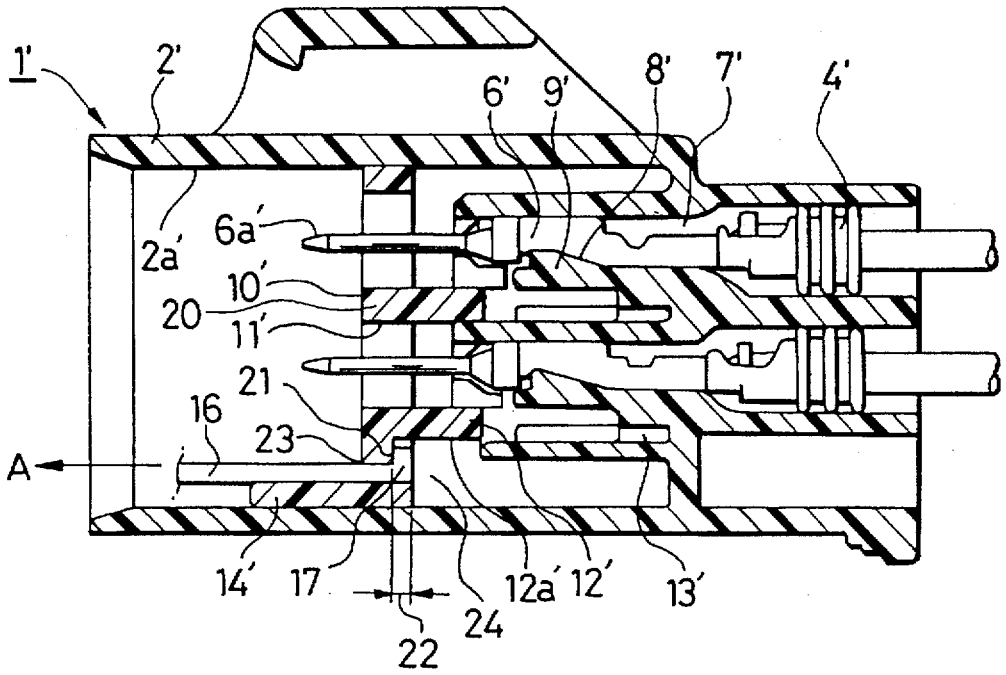
FIG. 1 is a vertical sectional view of a connector having positive terminals in a connector apparatus according to the present invention.
Figure 2:
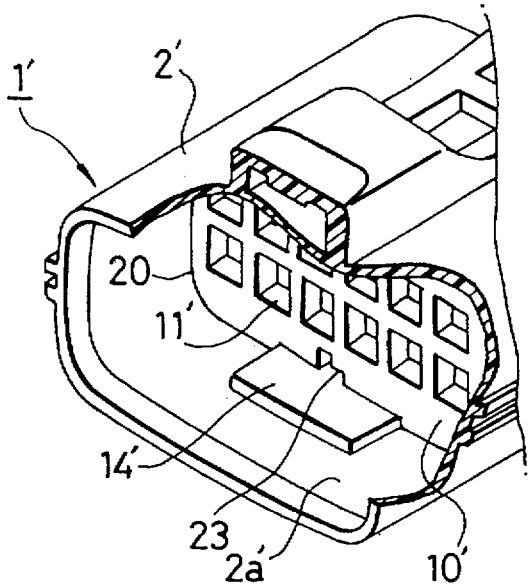
FIG. 2 is a perspective view of a front portion of a front holder in the connector according to the present invention.

A connector apparatus according to the present invention is similar in construction to the conventional connector apparatus except for the front holder. As shown in FIGS. 1 and 2, a connector 1' includes a housing 2' made of injection-molded synthetic resin, waterproofing plugs 4' and a plurality of positive terminals 6' each connected to electrical wires.

The housing 2' has a hood portion 2*a'* for protecting the positive terminals 6', in which a plurality of terminal receiving chambers 7' are bored therethrough, whereby the electrical joints 6*a'* of the plurality of positive terminals 6' can separately be fitted in the respective chambers 7'. Further, in the inner wall of each terminal receiving chamber 7', there is a lance 9' having a protrusion capable of mating with a recess 8' formed in the body of the positive terminal 6'.

The waterproofing plug 4' attached to the wire is fitted into one terminal-insertion end portion of the housing 2' to hermetically seal each wire.

Like the conventional front holder 3, on the other hand, a front holder 20 according to the present invention is inserted from the hood portion 2*a'* forming the front end portion of the housing 2' and the electrical joints 6*a'* of the positive terminals 6' are each passed through a plurality of holes 11' bored in a front wall portion. 10', whereas a plurality of spacers 12' extending from the front wall portion 10' are fitted into respective grooves 13' as deflection spaces of the lances 9' cut in a manner adjacent to the respective terminal receiving chambers 7' within the housing 2'.

The deflection of the lance 9' is regulated by the spacer 12' fitted into the groove 13', and the lance 9' is completely fixed in such a state that it is kept engaging with the recess of the positive terminals 6'.

Further, the present invention features that the front holder 20 has an inserted guide piece 14' and a pull-out guide piece 22 extending inward and outward along the same axial line from the front wall portion 10' and that an opening 23 is bored in the front wall portion 10' along the axial line.

Incidentally, the opening 23 has an open portion large enough to make the whole retaining head 17 pass therethrough and an adjoining pull-out portion 21 whose opening is slightly low so as to allow the engagement of the front wall portion 10' with the retaining head 17, whereby the opening 23 has a stepped upper edge.

Figure 3:
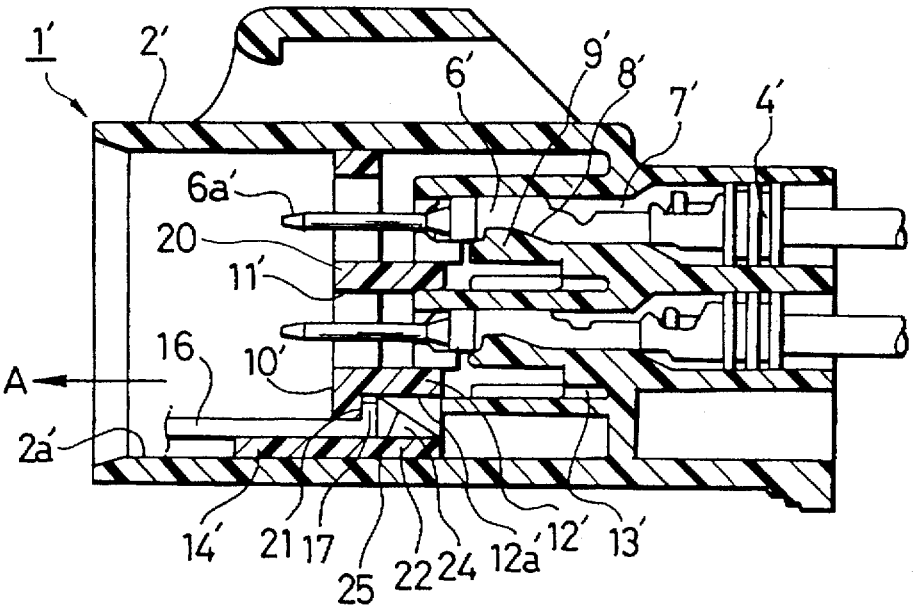
FIG. 3 is a vertical sectional view of an example of a modified connector according to the present invention.

As shown in FIG. 3, further, the front holder 20 according to the present invention may be arranged so that the retaining head 17 of the pullout tool 16 engaging with the pull-out portion 21 is completely surrounded by enlarging an internal space 24 sectioned with the rear portions 12*a'* of the spacers 12', the front wall portion 10' and the pull-out guide piece 22 by making the projected length of the pull-out guide piece 22 which is substantially equal to the projected length of the spacer 12'.

When the pull-out guide piece 22 is extended, it is preferred to add an auxiliary rib 25 in order the pull-out guide piece from to prevent deflecting.

Figure 4:
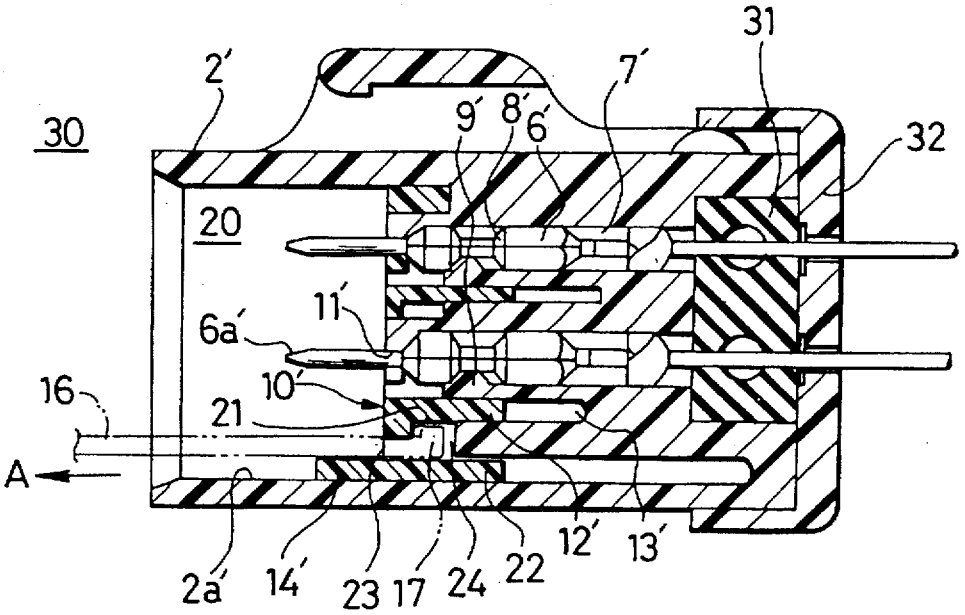
FIG. 4 is a vertical sectional view of an example of another modified connector according to the present invention.
Figure 5:
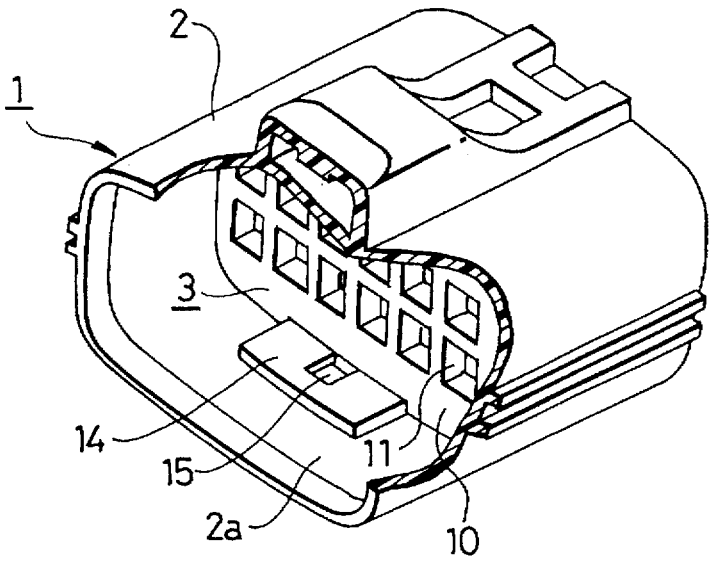
FIG. 5 PRIOR ART
FIG. 5 is a perspective view of a front portion of a front holder in a conventional connector.
Figure 6:
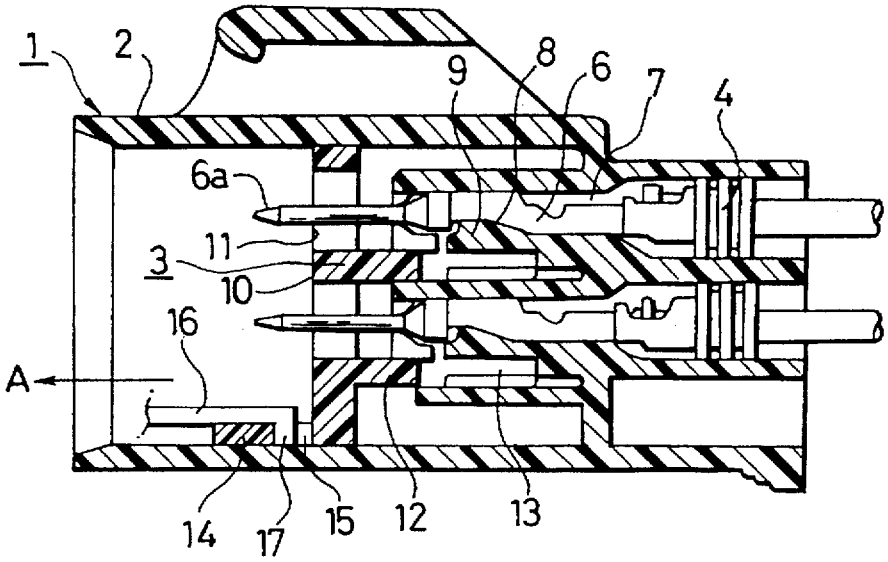
FIG. 6 PRIOR ART
FIG. 6 is a vertical sectional view of a connector having positive terminals in the conventional connector apparatus.
Figure 7:
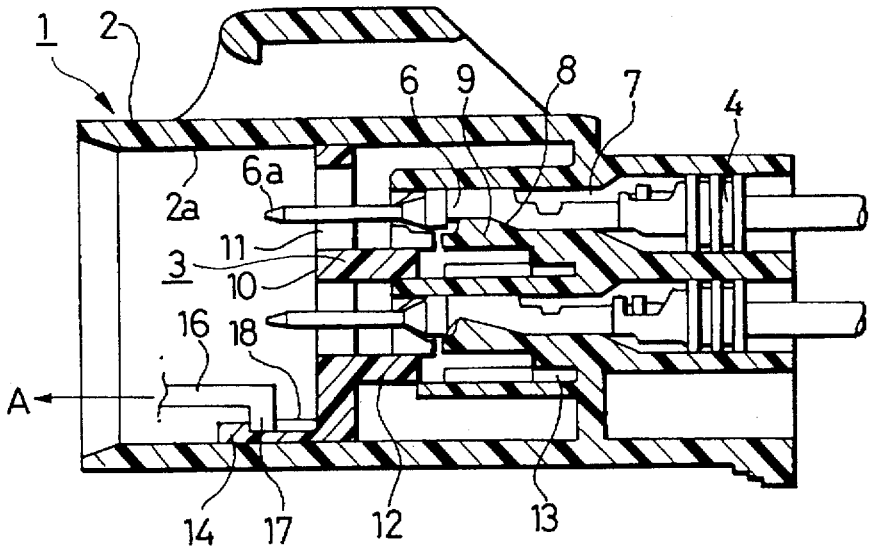
FIG. 7 PRIOR ART
FIG. 7 is a vertical sectional view of another connector having positive terminals in another connector apparatus.

As shown in FIG. 4, the aforementioned front holder 20 of the connector apparatus according to the present invention is also applicable to a connector 30 equipped with a mat seal 31 and a mat seal cover 32 in place of the waterproofing plugs of the connector 1 shown in FIGS. 1 and 3. The front holder is not limited in shape to what has been defined in the aforementioned embodiment of the present invention but may be an engaging piece in direct engagement with a terminal instead of the spacer.

In the connector apparatus according to the present invention including the housing 2', the terminal receiving chambers 7' into which the terminals 6' are inserted, and the terminal fixing front holder 20 which is fitted in the housing 2' from the front end portion of the housing 2', the terminal fixing front holder 20 has the pull-out portion 21 and the pull-out guide portion 22 extending inward from the front wall portion 10', whereas the opening 23 for use in inserting the jig is bored in the front wall portion 10', whereby the whole front holder 20 is smoothly guided and pulled out by the pull-out portion 21 and the pull-out guide portion 22 via the front wall portion 10' in parallel to the inner wall face of the hood portion 2*a'* of the housing 2'. It is thus possible to effectively suppress the inner wall face of the hood portion 2*a'* from being damagingly scratched against the coupling operation of the connector.

In the connector apparatus according to the present invention, further, since the pull-out portion 21 is formed between the front wall portion 10' and the rear portion 12*a'* of the spacer portion 12' extending inward from the front wall portion 10' along the same axial line as that of the pull-out guide portion 22, it is ensured that the retaining head 17 of the pull-out tool 16 engages with the pull-out portion 21 without touching the inner wall face of the hood portion 2*a'*.

In the connector apparatus according to the present invention, since the internal space 24 sectioned with the spacer portion 12', the front wall portion 10' and the pull-out guide portion 22 is completely surrounded therewith in such a condition that the retaining head 17 of the pullout tool 16 is pulled out, the inner wall face of the hood portion 2a' can be suppressed from being scratched thereby while the pull-out tool 16 is inserted and pulled out.

In the connector apparatus according to the present invention, further, since the pull-out guide portion 22 is extended up to substantially the same length of the spaces portion 12', the internal space surrounding the retaining head 17 of the pull-out tool 16 is enlarged and the parallel guide function of the extended pull-out guide piece 22 is increased, whereby the inner wall face of the hood portion 2a' is effectively suppressed from being scratched by the retaining head 17. Moreover, the front holder is never unsmoothly pulled out when it is pulled out as it is prevented from tilting in the hood portion.

However there has been described in connection with the preferred embodiment of the invention, of course, it is possible to variously change and modify the connector in view of the aspect of the invention.

Figure 8:
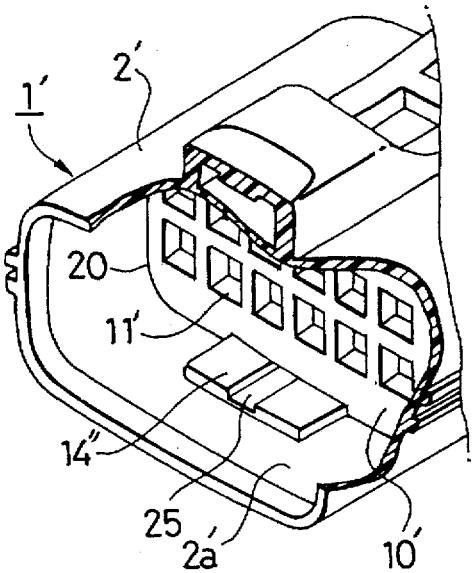
FIG. 8 is a perspective view of a front portion of the other modified front holder in the connector according to the present invention.

For example, as shown in FIG. 8, in place of the opening 23 bored in the front wall portion 10' with the stepped upper edge, a groove 35 for use in inserting the pull-out tool 16 may be extended in the surfaces of the inserted guide piece 14" and the pull-out guide piece 22 to effect modification in that the height of the upper edge of the opening 23 is uniformized.

Figure 9:
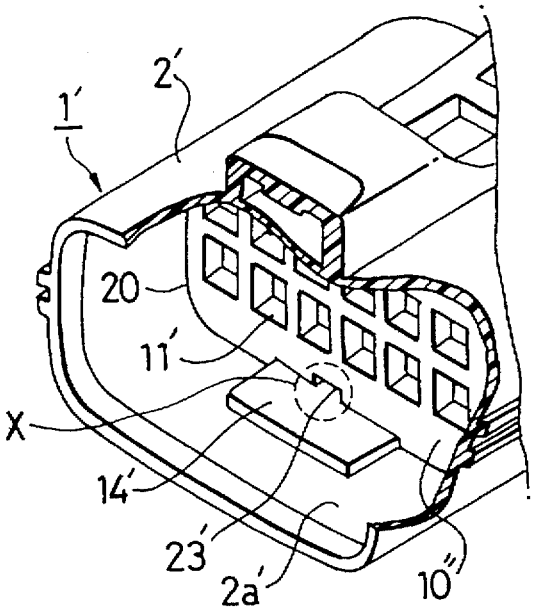
FIG. 9 is a perspective view of a front portion of the other modified front holder in the connector according to the present invention;.

For example, as shown in FIG. 9, in place of the opening 23 bored in the front wall portion 10' with the stepped upper edge, an opening 23' for allowing the insertion of the pull-out tool 16 may be bored in a front wall portion 10" to effect modification in that the height of the upper edge of the opening 23' is uniformized.

Figure 10:
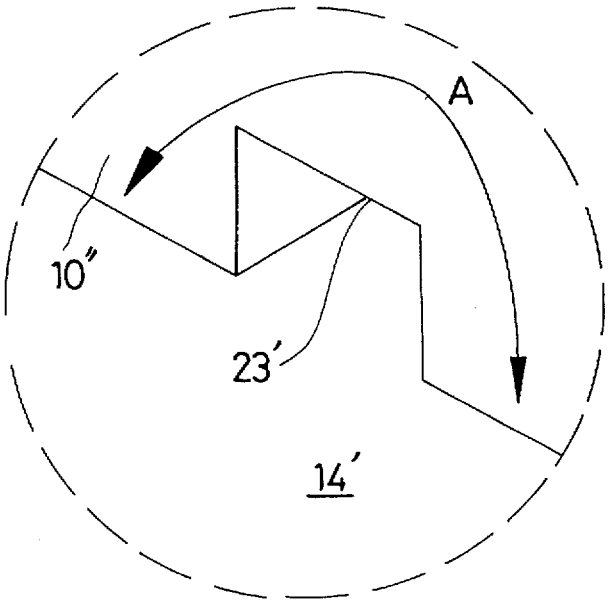
FIG. 10 is an enlarged view of a dot circle X indicated in FIG. 9.
Figure 3:
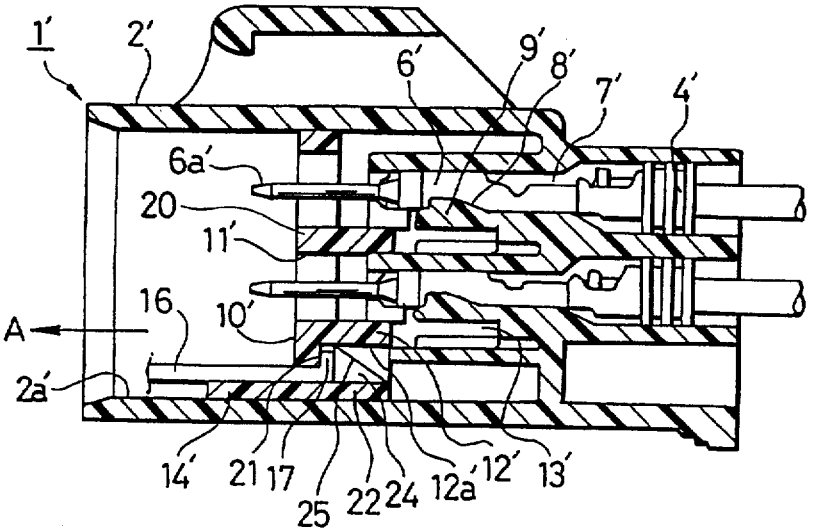
Figure 4:
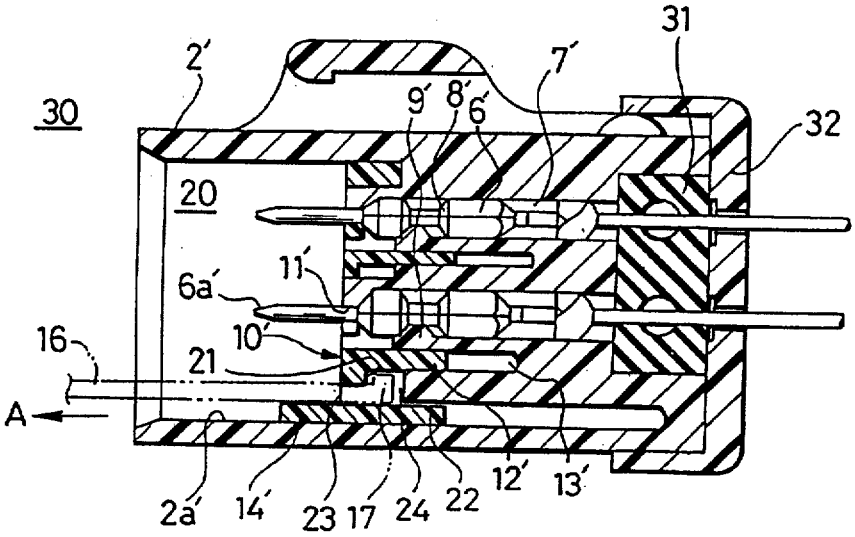
Figure 7:
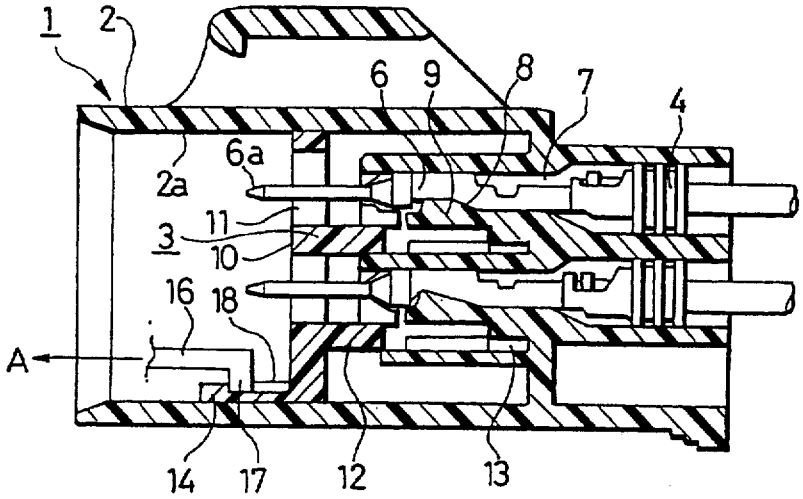
FIG.7 PRIOR ART
Figure 8:
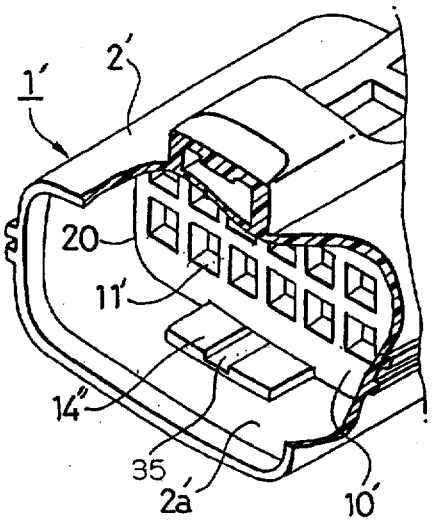

Namely, according to the aspect of the invention, as shown in FIG. 10, the pull-out tool 16 can engage with a rear surface of the front wall portion 10" about the opening 23' as indicated by arrow A.

What is claimed is:

1. A connector, comprising:

a housing;

a terminal receiving chamber, for receiving a terminal, formed in said housing; and a front holder fitted in said housing from a front end portion of said housing, said front holder including:

a front wall portion having an aperture therein in correspondence with said terminal receiving chamber, and an opening in said front wall portion, a pull-out portion, and a pull-out guide member which extends longitudinally of said front holder and which has a surface which partially defines said opening such that said opening is disposed immediately above said pull-out guide member, whereupon a pull-out tool is guided horizontally on said surface of said pull-out guide member and inserted through said opening in order to engage with said pull-out portion of said front holder.

2. The connector of claim 1, wherein said pull-out portion is formed between said front wall portion and a rear portion of a spacer portion extending inward from said front wall portion along the same axial line as said pull-out guide portion.

3. The connector of claim 2, wherein an internal space is defined by said spacer portion, said front wall portion and said surface of said pull-out guide member such that a retaining head of said pull-out tool engaging with said pull-out portion is surrounded by said internal space.

4. The connector of claim 2, wherein said pull-out guide portion is extended to substantially the same length of said spacer portion.

5. A connector, comprising:

a housing having a hood portion formed at a front portion thereof;

terminal receiving chambers, for receiving terminals, formed in said housing;

a front holder inserted from said hood portion into said housing, said front holder including:

a front wall portion having an aperture therein in correspondence with said terminal receiving chamber;

spacer portions rearwardly extending from said front wall portion;

a pull-out portion formed with one of said spacer portions, said pull-out portion being extended outwardly; and a pull-out guide member formed along an inner wall of said housing which has a surface which partially defines an opening such that said opening is disposed in said front wall portion immediately above said pull-out guide member, such that a pull-out tool is guided horizontally on said surface of said pull-out guide member and inserted through said opening in order to engage with said pull-out portion of said front holder.

6. The connector of claim 5, wherein said opening is defined by said front wall portion, said pull-out portion, and a groove formed on said surface of said pull-out guide member.

7. The connector of claim 5, wherein when said front holder is pulled out from said housing by the pull-out tool, said pull-out portion is engaged with the pull-out tool.

8. The connector of claim 5, wherein said opening is defined by a large area for passing the pull-out tool therethrough and a small area formed between said pull-out portion and said surface of said pull-out guide member.

9. The connector of claim 5, wherein said opening is formed in said front wall portion.

10. The connector of claim 9, wherein said opening is defined by said front wall portion, said pull-out portion, and said surface of said pull-out guide member.

11. The connector of claim 5, wherein said pull-out guide member extends rearwardly from said front wall portion.

12. The connector of claim 11, wherein said pull-out guide member has a rib portion formed thereon to prevent said pull-out guide member from deflecting.

13. The connector of claim 11 wherein said pull-out guide member extends frontwardly from said front wall portion.

14. The connector of claim 11 wherein said pull-out guide member is extended to substantially the same length of said spacer portions.

15. The connector of claim 14, wherein said pull-out guide member is substantially parallel with said spacer portions.

16. The connector of claim 5, wherein said terminal receiving chambers each have a separation wall and a retaining lance for retaining termianls.

17. The connector of claim 16, wherein a space is formed between said separation wall and said retaining lance, and wherein each spacer portion is inserted into said space in accordance with the insertion of said front holder.

18. A connector, comprising:

a housing having a hood portion formed at a front portion thereof;

terminal receiving chambers, for receiving terminals, formed in said housing;

a front holder inserted from said hood portion into said housing, said front holder including:

a front wall portion having an aperture therein in correspondence with said terminal receiving chamber;

spacer portions rearwardly extending from said front wall portion;

a pull-out guide member formed along an inner wall of said housing which has a surface which partially defines an opening such that said opening is disposed in said front wall portion immediately above said pull-out guide member, such that a pull-out tool is guided horizontally on said surface of said pullout guide member and inserted through said opening and a pull-out portion defined by a rear surface of said front wall portion about said opening, wherein said front holder is pulled out from said housing by the pull-out tool engaging with said pull-out portion.

* * * * *

UNITED STATES PATENT AND TRADEMARK OFFICE

CERTIFICATE OF CORRECTION

PATENT NO. : 5,730,626
DATED : Mar. 24, 1998
INVENTOR(S) : Yoshinori Tomita, et al It is certified that error appears in the above-identified patent and that said Letters Patent is hereby corrected as shown below:

The drawing sheets, consisting of Figs. 3 and 8, should be deleted to be replaced with the drawing sheets, consisting of Figs. 3 and 8, as shown on the attached pages.

Signed and Sealed this

Twenty-ninth Day of August, 2000

*Attest:*

*Attesting Officer*

Q. TODD DICKINSON

*Director of Patents and Trademarks*